United States Patent [19]

McDugle et al.

[11] Patent Number: 5,037,732

[45] Date of Patent: Aug. 6, 1991

[54] PHOTOGRAPHIC EMULSIONS CONTAINING INTERNALLY MODIFIED SILVER HALIDE GRAINS

[75] Inventors: Woodrow G. McDugle, Rochester; Alfred P. Marchetti, Penfield; John E. Keevert; Marian S. Henry, both of Rochester; Myra T. Olm, Webster, all of N.Y.

[73] Assignee: Eastman Kodak Company, Rochester, N.Y.

[21] Appl. No.: 399,723

[22] Filed: Aug. 28, 1989

[51] Int. Cl.[5] ..... G03C 1/08

[52] U.S. Cl. ..... 430/567; 430/569; 430/596; 430/604; 430/605; 430/606; 430/612

[58] Field of Search ..... 430/567, 569, 596, 604, 430/605, 606, 612

[56] References Cited

U.S. PATENT DOCUMENTS

| | | | |
|---|---|---|---|
| 2,448,060 | 8/1948 | Trivelli et al. | 430/603 |
| 3,790,390 | 2/1974 | Shiba et al. | 430/567 |
| 3,890,154 | 6/1975 | Ohkubo et al. | 430/434 |
| 4,126,472 | 11/1978 | Sakai et al. . | |
| 4,147,542 | 4/1979 | Habu et al. | 430/346 |
| 4,835,093 | 5/1989 | Janusonis et al. | 430/567 |

FOREIGN PATENT DOCUMENTS 242190 10/1987 European Pat. Off. .

OTHER PUBLICATIONS

Research Disclosure, vol. 176, Dec. 1978, Item 17643, Section IA and IIIA.

D. M. Samilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20-26, 1978.

B. H. Carroll, "Iridium Sensitization: A Literature Review", Photographic Science and Engineering, vol. 24, No. 6, Nov./Dec. 1980, pp. 265-267.

Eachus, R. S., "The Mechanism of $Ir^{3+}$ Sensitization of Silver Halide Materials", in a paper presented at the 1982 International Congress of Photographic Science, University of Cambridge.

Cotton, F. A. and Wilkinson, G., *Advanced Inorganic Chemistry*, 4th Ed., 1980, pp. 1052-1055.

*Primary Examiner*—Charles L. Bowers, Jr.
*Assistant Examiner*—Janet C. Baxter
*Attorney, Agent, or Firm*—Carl O. Thomas

[57] ABSTRACT

Photographic silver halide emulsions are disclosed comprised of radiation sensitive silver halide grains exhibiting a face centered cubic crystal lattice structure internally containing a carbonyl coordination ligand and a transition metal chosen from groups 8 and 9 of the periodic table of elements.

25 Claims, 1 Drawing Sheet

PHOTOGRAPHIC EMULSIONS CONTAINING INTERNALLY MODIFIED SILVER HALIDE GRAINS

FIELD OF THE INVENTION

The invention relates to photography. More specifically, the invention relates to photographic silver halide emulsions and to photographic elements containing these emulsions.

DEFINITION OF TERMS

All references to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

The term "dopant" refers to a material other than a silver or halide ion contained within a silver halide grain.

The term "transition metal" refers to any element of groups 3 to 12 inclusive of the periodic table of elements.

The term "heavy transition metal" refers to transition metals of periods 5 and 6 of the periodic table of elements.

The term "light transition metal" refers to transition metals of period 4 of the periodic table of elements.

The term "palladium triad transition metals" refers to period 5 elements in groups 8 to 10 inclusive—i.e., ruthenium, rhodium, and palladium.

The term "platinum triad transition metals" refers to period 6 elements in groups 8 to 10 inclusive—i.e., osmium, iridium, and platinum.

The acronym "EPR" refers to electron paramagnetic resonance.

The acronym "ESR" refers to electron spin resonance.

The term "$pK_{sp}$" indicates the negative logarithm of the solubility product constant of a compound.

Grain sizes, unless otherwise indicated, are mean effective circular diameters of the grains, where the effective circular diameter is the diameter of a circle having an area equal to the projected area of the grain.

Photographic speeds are reported as relative inertial speeds, except as otherwise indicated. The inertial speed of an emulsion lies at the intersection of the straight line projections of the minimum density and the maximum gradient portions of the emulsion characteristic curve. For a textbook example of inertial speed determination, note point i in FIG. 11.1, page 180, James and Higgins, Fundamentals of Photographic Theory, John Wiley & Sons, 1948.

Photographic contrasts are reported in terms of the maximum gradient of an emulsion characteristic curve, except as otherwise indicated.

PRIOR ART

Trivelli and Smith U.S. Pat. No. 2,448,060, issued Aug. 31, 1948, taught that silver halide emulsions can be sensitized by adding to the emulsion at any stage of preparation—i.e., before or during precipitation of the silver halide grains, before or during the first digestion (physical ripening), before or during the second digestion (chemical ripening), or just before coating, a compound of a palladium or platinum triad transition metal, identified by the general formula:

$$R_2MX_6$$

wherein

R represents a hydrogen, an alkali metal, or an ammonium radical,

M represents a palladium or platinum triad transition metal, and

X represents a halogen atom—e.g., chlorine or bromine.

The formula compounds are hexacoordinated heavy transition metal complexes which are water soluble. When dissolved in water $R_2$ dissociates as two cations while the transition metal and halogen ligands disperse as a hexacoordinated anionic complex.

With further investigation the art has recognized a distinct difference in the photographic effect of transition metal compounds in silver halide emulsions, depending upon whether the compound is introduced into the emulsion during precipitation of silver halide grains or subsequently in the emulsion making process. In the former instance it has been generally accepted that the transition metal can enter the silver halide grain as a dopant and therefore be effective to modify photographic properties, though present in very small concentrations. When transition metal compounds are introduced into an emulsion after silver halide grain precipitation is complete, the transition metals can be absorbed to the grain surfaces, but are sometimes largely precluded from grain contact by peptizer interactions. Orders of magnitude higher concentrations of transition metals are required to show threshold photographic effects when added following silver halide grain formation as compared to transition metals incorporated in silver halide grains as dopants. The art distinction between metal doping, resulting from transition metal compound addition during silver halide grain formation, and transition metal sensitizers, resulting from transition metal compound addition following silver halide grain formation, is illustrated by *Research Disclosure*, Vol. 176, December 1978, Item 17643, wherein Section IA, dealing with metal sensitizers introduced during grain precipitation, and Section IIIA, dealing with metal sensitizers introduced during chemical sensitization, provide entirely different lists of prior art teachings relevant to each practice. *Research Disclosure* is published by Kenneth Mason Publications, Ltd., Emsworth, Hampshire P010 7DD, England.

Since transition metal dopants can be detected in exceedingly small concentrations in silver halide grains and since usually the remaining elements in the transition metal compounds introduced during grain precipitation are much less susceptible to detection (e.g., halide or aquo ligands or halide ions), grain analysis has focused on locating and quantifying the transition metal dopant concentration in the grain structure. While Trivelli and Smith taught to employ only anionic hexacoordinated halide complexes of transition metals, many if not most listings of transition metal compounds to be introduced during silver halide grain formation have indiscriminately lumped together simple salts of transition metals and transition metal complexes. This is evidence that the possibility of ligand inclusion in grain formation or any modification in performance attributable thereto was overlooked.

In fact, a survey of the photographic literature identifies very few teachings of adding to silver halide emulsions during grain formation compounds of transition metals in which the transition metal is other than a palladium and platinum triad transition metal and the remainder of the compound is provided by other than halide ligands, halide and aquo ligands, halides which dissociate to form anions in solution, or ammonium or alkali metal moieties that dissociate to form cations in solution. The following is a listing of the few variant teachings that have been identified:

Shiba et al U.S. Pat. No. 3,790,390 discloses preparing a blue responsive silver halide emulsion suitable for flash exposure which can be handled under bright yellowish-green light. The emulsion contains grains with a mean size no larger than 0.9 μm, at least one group 8-10 metal compound, and a formula specified merocyanine dye. Examples of transition metal compounds are simple salts of light transition metals, such as iron, cobalt, and nickel salts, and hexacoordinated complexes of light transition metals containing cyanide ligands. Heavy transition metal compounds are disclosed only as the usual simple salts or hexacoordinated complexes containing only halide ligands. Palladium (II) nitrate, a simple salt, is also disclosed as well as palladium tetrathiocyanatopalladate (II), a tetracoordinated complex of palladium.

Ohkubo et al U.S. Pat. No. 3,890,154 and Habu et al U.S. Pat. No. 4,147,542 are similar to Shiba et al, differing principally in employing different sensitizing dyes to allow recording of green flash exposures.

Sakai et al U.S. Pat. No. 4,126,472 discloses producing a high contrast emulsion suitable for lith photography by ripening an emulsion containing at least 60 mole percent silver chloride in the presence of $10^{-6}$ to $10^{-4}$ mole per mole of silver halide of a water soluble iridium salt and further adding a hydroxytetraazaindene and a polyoxyethylene compound. In addition to the usual iridium halide salts and hexacoordinated iridium complexes containing halide ligands Sakai et al discloses cationic hexacoordinated complexes of iridium containing amine ligands. Since iridium is introduced after silver halide precipitation is terminated, the iridium is not employed as a grain dopant, but as a grain surface modifier. This undoubtedly accounts for the variance from conventional iridium compounds used for doping.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20-26, 1978, reported investigations of chloride iridium, rhodium, and gold complexes and, in addition, an emulsion prepared by introducing $(NH_4)_6Mo_7O_{24}4H_2O$.

At the 1982 International Congress of Photographic Science at the University of Cambridge, R. S. Eachus presented a paper titled, "The Mechanism of $Ir^{3+}$ Sensitization of Silver Halide Materials", wherein inferential electron paramagnetic resonance (EPR) spectroscopic evidence was presented that $Ir^{3+}$ ions were incorporated into melt-grown silver bromide and silver chloride crystals as $(IrBr_6)^{-3}$ and $(IrCl_6)^{-3}$. In emulsions and sols of these salts, the hexabromoiridate and hexachloroiridate molecular ions, as well as similar complexes containing mixed halides, were introduced during precipitation. The aquated species $[IrCl_4(H_2O)_2]^{-1}$ and $[IrCl_5(H_2O)]^{-2}$ were also successfully doped into precipitates of both silver salts. Eachus went on to speculate on various mechanisms by which incorporated iridium ions might contribute to photogenerated free electron and hole management, including latent image formation.

B. H. Carroll, "Iridium Sensitization: A Literature Review", *Photographic Science and Engineering*, Vol. 24, No. 6, November/December 1980, pp. 265-267, is cited for further background on conventional photographic uses of iridium.

Greskowiak published European Patent Application 0,242,190/A2 discloses reductions in high intensity reciprocity failure in silver halide emulsions formed in the presence of one or more complex compounds of rhodium (III) having 3, 4, 5, or 6 cyanide ligands attached to each rhodium ion.

Janusonis et al, U.S. Pat. No. 4,835,093 discloses incorporating either rhenium ions or rhenium hexacoordination complexes into silver halide grains. Rhenium hexacoordination complex ligands disclosed are halide, nitrosyl, thionitrosyl, cyanide, aquo, cyanates (i.e., cyanate, thiocyanate, selenocyanate, and tellurocyanate), and azide ligands. Varied photographic effects are disclosed, depending on halide content, the surface sensitization or fogging of the grains, and the level of rhenium doping.

RELATED PATENT APPLICATIONS

McDugle et al U.S. Ser. No. 179,376, filed Apr. 8, 1988, commonly assigned, titled PHOTOGRAPHIC EMULSION CONTAINING INTERNALLY MODIFIED SILVER HALIDE GRAINS, now U.S. Pat. No. 4,933,272, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements.

Keevert et al U.S. Ser. No. 179,377, filed Apr. 8, 1988, commonly assigned, titled PHOTOGRAPHIC EMULSIONS CONTAINING INTERNALLY MODIFIED SILVER HALIDE GRAINS, now U.S. Pat. No. 4,945,035, discloses photographic emulsions comprised of radiation sensitive silver halide grains containing greater than 50 mole percent chloride and less than 5 mole percent iodide, based on total silver, with any residual halide being bromide. The grains exhibit a face centered cubic crystal structure formed in the presence of a hexacoordination complex of rhenium, ruthenium, or osmium with at least four cyanide ligands. The emulsions exhibit increased sensitivity.

Marchetti et al U.S. Ser. No. 179,378, filed Apr. 8, 1988, now U.S. Pat. No. 4,933,272, commonly assigned, titled PHOTOGRAPHIC EMULSIONS CONTAINING INTERNALLY MODIFIED SILVER HALIDE GRAINS, now U.S. Pat. No. 4,937,180, discloses photographic emulsions comprised of radiation sensitive silver bromide or bromoiodide grains which exhibit a face centered cubic crystal structure formed in the presence of a hexacoordination complex of rhenium, ruthenium, or osmium with at least four cyanide ligands. The emulsions exhibit increased stability. Also, reductions in low intensity reciprocity failure are observed in these emulsions.

SUMMARY OF THE INVENTION

In one aspect this invention is directed to a photographic silver halide emulsion comprised of radiation sensitive silver halide grains exhibiting a face centered cubic crystal lattice structure internally containing a hexacoordination complex that satisfies the formula:

$$[M(CO)_mL_{6-m}]^n$$

where

M is a transition metal selected from groups 8 and 9 of the periodic table of elements;

L is a bridging ligand;

m is 1, 2, or 3; and n is −1, −2, or −3.

Silver halide photography serves a wide spectrum of imaging needs. The amateur 35 mm photographer expects to capture images reliably over the full range of shutter speeds his or her camera offers, typically ranging from 1/10 of second or longer to 1/1000 of a second or less, under lighting conditions ranging from the most marginal twilight to mid-day beach and ski settings, with pictures being taken in a single day or over a period of months and developed immediately or months after taking, with the loaded camera often being left in an automobile in direct sun and stifling heat in the summer or overnight in mid-winter. These are stringent demands to place on the complex chemical system which the film represents. Parameters such as speed, contrast, fog, pressure sensitivity, high and low intensity reciprocity failures, and latent image keeping are all important in achieving acceptable photographic performance.

While specialized and professional photography seldom places such diverse demands on a single film as the amateur photographer, even more stringent performance criteria are routinely encountered that must be invariantly satisfied. Action and motion study photography requires extremely high photographic speeds. High shutter speeds often require high intensity exposures. For such applications high intensity reciprocity failure must be avoided. Astronomical photography also requires high levels of photographic sensitivity, but exposure times can extend for hours to capture light from faint celestial objects. For such applications low intensity reciprocity failure is to be avoided. For medical radiography high photographic speeds are required and resistance to localized pressure modification of sensitivity (e.g., kink desensitization) is particularly important in larger formats. Portrait photography requires a choice of contrasts, ranging from low to moderately high, to obtain the desired viewer response. Graphic arts photography requires extremely high levels of contrast. In some instances speed reduction (partial desensitization) is desired to permit handling of the film under less visually fatiguing lighting conditions (e.g., room light and/or green or yellow light) than customary red safe lighting. Color photography requires careful matching of the blue, green, and red photographic records, over the entire useful life of a film. While most silver halide photographic materials produce negative images, positive images are required for many applications. Both direct positive imaging and positive imaging of negative-working photographic materials by reversal processing serve significant photographic needs.

In attempting to tailor the properties of silver halide photographic materials to satisfy specific imaging requirements, there has emerged a general recognition of the utility of transition metal dopants in radiation-sensitive silver halide grains. Progress in modifying emulsion properties by transition metal doping has, however, reached a plateau, since there are only a limited number of transition metals as well as a limited number of possible transition metal concentrations and placements within the grain.

The present invention is based on the recognition that the transition metal complexes, including both the transition metal and its ligands, can be included internally within the face centered cubic crystal structure of radiation-sensitive silver halide grains to modify photographic properties. Further, the ligands as well as the transition metal play a significant role in determining photographic performance. By choosing one or more novel ligands for incorporation in the silver halide grains, useful modifications of the silver halide photographic emulsions can be realized.

In one aspect this invention is directed to photographic emulsions comprised of radiation sensitive silver halide grains exhibiting a face centered cubic crystal lattice structure internally containing a carbonyl coordination ligand and a transition metal selected from groups 8 and 9 of the periodic table of elements.

DESCRIPTION OF PREFERRED EMBODIMENTS

Figure 1:
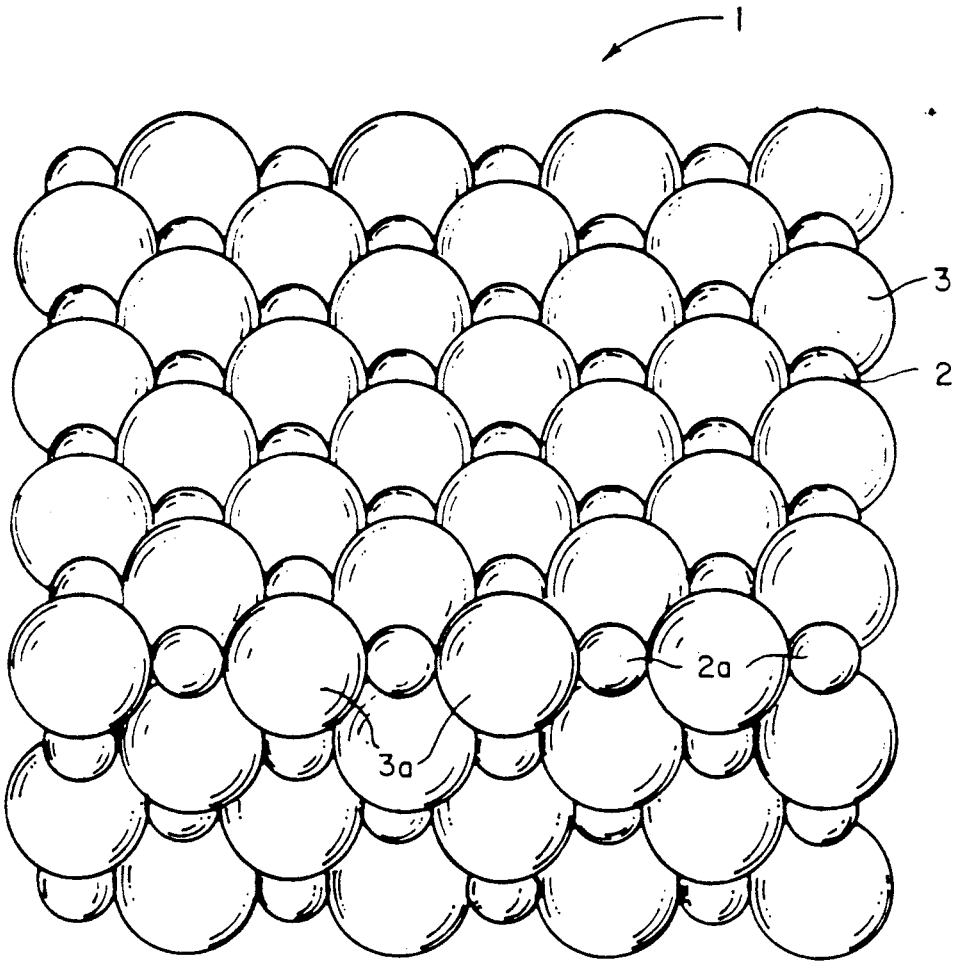
FIG. 1 is a schematic view of a silver bromide crystal structure with the upper layer of ions lying along a {100} crystallographic face.

Unlike silver iodide, which commonly forms only $\beta$ and $\gamma$ phases, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of ions shown counting from the bottom of FIG. 1 lie in a {100} crystallographic plane which perpendicularly intersects the {100} crystallographic plane occupied by the upper layer of ions. The row containing silver ions **2*a* and bromide ions 3*a*** lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The arrangement of ions in a silver chloride crystal is the same as that shown in FIG. 1, except that chloride ions are smaller than bromide ions. Silver halide grains in photographic emulsions can be formed of bromide ions as the sole halide, chloride ions as the sole halide, or any mixture of the two. It is also common practice to incorporate minor amounts of iodide ions in photographic silver halide grains. Since chlorine, bromine, and iodine are 3rd, 4th, and 5th period elements, respectively, the iodide ions are larger than the bromide ions. As much as 40 mole percent of the total halide in a silver bromide cubic crystal lattice structure can be accounted for by iodide ions before silver iodide separates as a separate phase. In photographic emulsions iodide concentrations in silver halide grains seldom exceeds 20 mole percent and is typically less than 10 mole percent, based on silver. However, specific applications differ widely in their use of iodide. Silver bromoiodide emulsions are employed in high speed (ASA 100 or greater) camera films, since the presence of iodide allows higher speeds to be realized at any given level of granularity. Silver bromide emulsions or silver bromoiodide emulsions containing less than 5 mole percent iodide are customarily employed for radiography. Emulsions employed for graphic arts and color paper typically contain greater than 50 mole percent, preferably greater than 70 mole percent, and optimally greater than 85 mole percent, chloride, but less than 5 mole percent, preferably less than 2 mole percent, iodide, any balance of the halide not accounted for by chloride or iodide being bromide.

The present invention is concerned with photographic silver halide emulsions in which a transition metal complex has been internally introduced into the cubic crystal structure of the grain. The parameters of such an incorporated complex can be roughly appreciated by considering the characteristics of a single silver ion and six adjacent halide ions (hereinafter collectively referred to as the seven vacancy ions or $[AgX_6]^{-5}$) that must be omitted from the crystal structure to accommodate spatially a hexacoordinated transition metal complex. The seven vacancy ions exhibit a net charge of $-5$. This suggests that anionic transition metal complexes should be more readily incorporated in the crystal structure than neutral or cationic transition metal complexes. This also suggests that the capability of a hexacoordinated transition metal complex to trap either photogenerated holes or electrons may be determined to a significant degree by whether the complex introduced has a net charge more or less negative than the seven vacancy ions it displaces. This is an important departure from the common view that transition metals are incorporated into silver halide grains as bare elements and that their hole or electron trapping capability is entirely a function of their oxidation state.

Referring to FIG. 1, it should be further noted that the silver ions are much smaller than the bromide ions, though silver lies in the 5th period while bromine lies in the 4th period. Further, the lattice is known to accommodate iodide ions, which are still larger than bromide ions. This suggests that the size of 5th and 6th period transition metals should not in itself provide any barrier to their incorporation. A final observation that can be drawn from the seven vacancy ions is that the six halide ions exhibit an ionic attraction not only to the single silver ion that forms the center of the vacancy ion group, but are also attracted to other adjacent silver ions.

The present invention employs within silver halide grains transition metal coordination complexes containing a central transition metal ion and coordinated ligands. The preferred coordination complexes for incorporation are hexacoordination complexes, since these coordination complexes each take the place of a silver ion with the six coordination ligands taking the place of six halide ions next adjacent to the displaced silver ion.

To appreciate that a coordination complex of a transition metal having ligands other than halide ligands or, as recognized by Eachus, cited above, aquo ligands, can be accommodated into silver halide cubic crystal lattice structure it is necessary to consider that the attraction between the transition metal and its ligands may not be entirely, but to at least some extent the result of covalent bonding, the latter being much stronger than the former. Since the size of a hexacoordinated complex is determined not only by the size of the atoms forming the complex, but also by the strength of the bonds between the atoms, a coordination complex can be spatially accommodated into a silver halide crystal structure in the space that would otherwise be occupied by the vacancy ions, even though the number and/or diameters of the individual atoms forming the complex exceeds that of the vacancy ions. This is because the covalent bond strength can significantly reduce bond distances and therefore the size of the entire complex. It is a specific recognition of this invention that multielement ligands of transition metal coordination complexes can be spatially accommodated to single halide ion vacancies within the crystal structure.

While spatial compatibility is important in choosing suitable transition metal coordination complexes, another factor which must be taken into account is the compatibility of the complex with the next adjacent ions in the crystal lattice structure. It is the recognition of this invention that compatibility can be realized by choosing bridging ligands for the transition metal complex. Looking at a single row of silver and halide ions in a cubic crystal lattice structure, the following relationship can be observed:

$$Ag^+X^-Ag^+X^-Ag^+X^-Ag^+X^-, \text{etc.}$$

Notice that the halide ions X are attracting both adjacent silver ions in the row. When the portion of a transition metal coordination complex lying in a single row of silver and halide ions in a crystal structure is considered, the following relationship can be observed:

$$Ag^+X^-Ag^+\text{-}L\text{-}M\text{-}L\text{-}Ag^+X^-, \text{etc.}$$

where

M represents a transition metal and

L represents a bridging ligand.

While only one row of silver and halide ions is shown, it is appreciated that the complex forms part of three identical perpendicular rows of silver and halide ions having the transition metal M as their point of intersection.

By considering the crystal structure of silver halide it is apparent that the art has in all probability been fully justified in employing simple transition metal halide salts and hexacoordinated transition metal complexes containing only halide ligands interchangeably to obtain identical photographic effects. Not only has the art failed to recognize any advantage or modification in photographic properties attributable to halide ion inclusion, it has also failed to observe any photographic property modification attributable to aquo ligand inclusion. On this latter point, it should be noted that silver halide grains are routinely precipitated in aqueous media containing halide ions, raising significant doubts about whether any grain structure modification was achieved by the substitution of one or two aquo ligands for halide ligands in hexacoordinated metal transition complexes. There are two possible explanations, either aquo ligands may exchange with halide ions prior to or during precipitation or aquo occlusions may be more common than generally appreciated.

The present invention runs counter to the accepted teachings of the art. The art has conducted extensive experimental investigation in the 40 years following the discoveries of Trivelli and Smith, cited above, and reported that similar photographic performance is realized whether transition metals are internally introduced into silver halide grains by addition to the precipitation medium as simple salts, haloligand transition complexes, or comparable halo complexes having one or more of the halo ligands displaced by aquo ligands.

The essential contribution which this invention makes to the art is the recognition that transistion metal coordination complexes containing carbonyl ligands can play a significant role in modifying photographic performance. The transition metals known to form complexes with carbonyl ligands are the transition metals of groups 8 and 9 of the periodic table of elements. As many as three carbonyl ligands per transition metal atom can be present in the coordination complexes.

The preferred transition metal carbonyl ligand coordination complexes are those which satisfy the following formula:

$$[M(CO)_mL_{6-m}]^n \quad (I)$$

where

M is a transition metal selected from groups 8 and 9 of the periodic table of elements;

L is a bridging ligand;

m is 1, 2, or 3; and n is −1, −2, or −3.

Bridging ligands are those which can serve as bridging groups between two or more metal centers. Bridging ligands can be either monodentate or ambidentate. A monodentate bridging ligand has only one ligand atom that forms two (or more) bonds to two (or more) different metal atoms. For monoatomic ligands, such as halides, and for ligands containing only one possible donor atom, the monodentate form of bridging is the only possible one. Multielement ligands with more than one donor atom can also function in a bridging capacity and are referred to as ambidentate ligands.

Specific examples of preferred bridging ligands include halide ligands (specifically, fluoride, chloride, bromide, and iodide); aquo (HOH) ligands; cyanide ligands; ligands that are cyanates—i.e., cyanate, thiocyanate, selenocyanate, and tellurocyanate ligands; and azide ligands. Still other bridging ligand choices are possible.

The transistion metal coordination complexes contemplated for grain incorporation exhibit a negative net ionic charge. Since carbonyl ligands are charge neutral, the more carbonyl ligands contained in the complex, the lower the net negative charge. However, even with three carbonyl ligands present, the maximum number identified known complexes, the complexes retain a net negative charge of −1. One or more counter ions are therefore associated with the complex to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

Table I provides a listing of illustrative compounds of hexacoordinated heavy transition metal complexes satisfying the requirements of the invention:

| | |
|---|---|
| TMC-1 | $[Os(CO)Cl_5]^{-2}$ |
| TMC-2 | $[Os(CO)Br_5]^{-2}$ |
| TMC-3 | $[Os(CO)I_5]^{-2}$ |
| TMC-4 | $[Ru(CO)Cl_5]^{-2}$ |
| TMC-5 | $[Ru(CO)Br_5]^{-2}$ |
| TMC-6 | $[Ru(CO)I_5]^{-2}$ |
| TMC-7 | $[Os(CO)Cl_4(H_2O)]^{-2}$ |
| TMC-8 | $[Os(CO)Br_4(H_2O)]^{-2}$ |
| TMC-9 | $[Os(CO)I_4(H_2O)]^{-2}$ |
| TMC-10 | $[Ru(CO)Cl_4(H_2O)]^{-2}$ |
| TMC-11 | $[Ru(CO)Br_4(H_2O)]^{-2}$ |
| TMC-12 | $[Ru(CO)I_4(H_2O)]^{-2}$ |
| TMC-13 | $[Os(CO)Cl_4(CN)]^{-3}$ |
| TMC-14 | $[Os(CO)Br_4(CN)]^{-3}$ |
| TMC-15 | $[Os(CO)(CN)_5]^{-3}$ |
| TMC-16 | $[Ru(CO)Cl_4(CN)]^{-3}$ |
| TMC-17 | $[Ru(CO)I_4(CN)]^{-3}$ |
| TMC-18 | $[Ru(CO)(CN)_5]^{-3}$ |
| TMC-19 | $[Os(CO)Cl_4(SCN)]^{-3}$ |
| TMC-20 | $[Os(CO)Br_4(SCN)]^{-3}$ |
| TMC-21 | $[Os(CO)(SCN)_5]^{-3}$ |
| TMC-22 | $[Ru(CO)I_4(SCN)]^{-3}$ |
| TMC-23 | $[Ru(CO)Br_4(SCN)]^{-3}$ |
| TMC-24 | $[Ru(CO)(SCN)_5]^{-3}$ |
| TMC-25 | $[Os(CO)Cl_4(OCN)]^{-3}$ |
| TMC-26 | $[Os(CO)Br_4(OCN)]^{-3}$ |
| TMC-27 | $[Os(CO)I_4(OCN)]^{-3}$ |
| TMC-28 | $[Ru(CO)Cl_4(OCN)]^{-3}$ |
| TMC-29 | $[Ru(CO)Br_4(OCN)]^{-3}$ |
| TMC-30 | $[Ru(CO)(OCN)_5]^{-3}$ |
| TMC-31 | $[Os(CO)Cl_4(SeCN)]^{-3}$ |
| TMC-32 | $[Os(CO)Br_4(SeCN)]^{-3}$ |
| TMC-33 | $[Os(CO)I_4(SeCN)]^{-3}$ |
| TMC-34 | $[Ru(CO)Cl_4(SeCN)]^{-3}$ |
| TMC-35 | $[Ru(CO)Br_4(SeCN)]^{-3}$ |
| TMC-36 | $[Ru(CO)I_4(SeCN)]^{-3}$ |
| TMC-37 | $[Os(CO)_2Cl_4]^{-2}$ |
| TMC-38 | $[Os(CO)_2Br_4]^{-2}$ |
| TMC-39 | $[Os(CO)_2I_4]^{-2}$ |
| TMC-40 | $[Ru(CO)_2Cl_4]^{-2}$ |
| TMC-41 | $[Ru(CO)_2Br_4]^{-2}$ |
| TMC-42 | $[Ru(CO)_2I_4]^{-2}$ |
| TMC-43 | $[Os(CO)_3Cl_3]^{-1}$ |
| TMC-44 | $[Os(CO)_3Br_3]^{-1}$ |
| TMC-45 | $[Os(CO)_3I_3]^{-1}$ |
| TMC-46 | $[Ru(CO)_3Cl_3]^{-1}$ |
| TMC-47 | $[Ru(CO)_3Br_3]^{-1}$ |
| TMC-48 | $[Ru(CO)_3I_3]^{-1}$ |
| TMC-49 | $[Ir(CO)Cl_5]^{-2}$ |
| TMC-50 | $[Ir(CO)Br_5]^{-2}$ |
| TMC-51 | $[Ir(CO)I_5]^{-2}$ |
| TMC-52 | $[Rh(CO)Cl_5]^{-2}$ |
| TMC-53 | $[Rh(CO)Br_5]^{-2}$ |
| TMC-54 | $[Rh(CO)I_5]^{-2}$ |
| TMC-55 | $[Os(CO)Cl_4(N_3)]^{-3}$ |
| TMC-56 | $[Os(CO)Br_4(N_3)]^{-3}$ |
| TMC-57 | $[Os(CO)I_4(N_3)]^{-3}$ |
| TMC-58 | $[Ru(CO)Cl_4(N_3)]^{-3}$ |
| TMC-59 | $[Ru(CO)Br_4(N_3)]^{-3}$ |
| TMC-60 | $[Ru(CO)I_4(N_3)]^{-3}$ |
| TMC-61 | $[Fe(CO)(CN)_5]^{-3}$ |
| TMC-62 | $[Fe(CO)Cl(CN)_4]^{-3}$ |
| TMC-63 | $[Fe(CO)Br(CN)_4]^{-3}$ |
| TMC-64 | $[Fe(CO)I(CN)_4]^{-3}$ |
| TMC-65 | $[Fe(CO)Cl_4(CN)]^{-3}$ |
| TMC-66 | $[Fe(CO)Br_4(CN)]^{-3}$ |
| TMC-67 | $[Fe(CO)I_4(CN)]^{-3}$ |
| TMC-68 | $[Co(CO)(CN)_5]^{-2}$ |
| TMC-69 | $[Co(CO)(SCN)_5]^{-2}$ |
| TMC-70 | $[Co(CO)(N_3)_5]^{-2}$ |
| TMC-71 | $[Co(CO)(CN)_4Cl]^{-2}$ |
| TMC-72 | $[Co(CO)(CN)_4Br]^{-2}$ |
| TMC-73 | $[Co(CO)(CN)_4I]^{-2}$ |

Procedures for beginning with the compounds of Table I and preparing photographic silver halide emulsions benefitted by incorporation of the hexacoordinated transition metal complex can be readily appreciated by considering the prior teachings of the art relating to introducing transition metal dopants in silver halide grains. Such teachings are illustrated by Wark U.S. Pat. No. 2,717,833; Berriman U.S. Pat. No. 3,367,778; Burt U.S. Pat. No. 3,445,235; Bacon et al U.S. Pat. No. 3,446,927; Colt U.S. Pat. No. 3,418,122; Bacon U.S. Pat. No. 3,531,291; Bacon U.S. Pat. No. 3,574,625; Japanese Patent (Kokoku) 33781/74 (priority May 10, 1968); Japanese Patent (Kokoku) 30483/73 (priority Nov. 2, 1968); Ohkubo et al U.S. Pat. No. 3,890,154; Spence et al U.S. Pat. Nos. 3,687,676 and 3,690,891; Gilman et al U.S. Pat. No. 3,979,213; Motter U.S. Pat. No. 3,703,584; Japanese Patent (Kokoku) 32738/70 (priority Oct. 22, 1970); Shiba et al U.S. Pat. No. 3,790,390; Yamasue et al U.S. Pat. No. 3,901,713; Nishina et al U.S. Pat. No. 3,847,621; *Research Disclosure*, Vol. 108, Apr. 1973, Item 10801; Sakai U.S. Pat. No. 4,126,472; Dostes et al Defensive Publication T962,004 and French Patent 2,296,204; U.K. Specification 1,527,435 (priority Mar. 17, 1975); Japanese Patent Publication (Kokai) 107,129/76 (priority Mar. 18, 1975); Habu et al U.S. Pat. Nos. 4,147,542 and 4,173,483; *Research Disclosure*, Vol. 134, June 1975, Item 13452; Japanese Patent Publication (Kokai) 65,432/77 (priority Nov. 26, 1975); Japanese Patent Publication (Kokai) 76,923/77 (priority Dec. 23, 1975); Japanese Patent Publication (Kokai) 88,340/77 (priority Jan. 26, 1976); Japanese Patent Publication (Kokai) 75,921/78 (priority Dec. 17, 1976); Okutsu et al U.S. Pat. No. 4,221,857; Japanese Patent Publication (Kokai) 96,024/79 (priority Jan. 11, 1978); *Research Disclosure*, Vol. 181, May 1979, Item 18155; Kanisawa et al U.S. Pat. No. 4,288,533; Japanese Patent Publication (Kokai) 25,727/81 (priority Aug. 7, 1979); Japanese Patent Publication (Kokai) 51,733/81 (priority Oct. 2, 1979); Japanese Patent Publication (Kokai) 166,637/80 (priority Dec. 6, 1979); and Japanese Patent Publication (Kokai) 149,142/81 (priority Apr. 18, 1970); the disclosures of which are here incorporated by reference.

When silver halide grains are formed a soluble silver salt, usually silver nitrate, and one or more soluble halide salts, usually an ammonium or alkali metal halide salt, are brought together in an aqueous medium. Precipitation of silver halide is driven by the high $pK_{sp}$ of silver halides, ranging from 9.75 for silver chloride to 16.09 for silver iodide at room temperature. For a transition metal complex to coprecipitate with silver halide it is preferred that it also form a high $pK_{sp}$ compound. If the $pK_{sp}$ is too low, precipitation may not occur. On the other hand, if the $pK_{sp}$ is too high, the compound may precipitate as a separate phase. Optimum $pK_{sp}$ values for silver or halide counter ion compounds of transistion metal complexes should be in or near the range of $pK_{sp}$ values for photographic silver halides—that is, in the range of from about 8 to 20, preferably about 9 to 17. Since transition metal complexes having only halide ligands or only aquo and halide ligands are known to coprecipitate with silver halide, substitution of one or three carbonyl ligands is generally compatible with coprecipitation.

The transition metal complexes satisfying the requirements of the invention can be incorporated in silver halide grains in the same concentrations, expressed in moles per mole of silver, as have been conventionally employed for transition metal doping. An extremely wide range of concentrations has been taught, ranging from as low as $10^{-10}$ mole/Ag mole taught by Dostes et al, cited above, for reducing low intensity reciprocity failure and kink desensitization in negative-working emulsions, to concentrations as high as $10^{-3}$ mole/Ag mole, taught by Spencer et al, cited above, for avoidance of dye desensitization. However, in the overwhelming majority of applications transition metal dopants are incorporated in silver halide grains in concentrations ranging from $10^{-9}$ to $10^{-4}$ mole per silver mole. Depending upon the specific photographic effect sought, emulsions containing the transition metal carbonyl coordination complexes of this invention are effective in this concentration range.

In considering the effectiveness of the transition metal complexes at differing concentrations it is necessary to differentiate between iridium and the remaining transition metals. For the complexes satisfying the requirements of this invention containing transition metals from period 5 and/or group 8 of the periodic table (i.e., all of the transition metals other than iridium contemplated for use with carbonyl ligands) useful photographic effects observable following exposure and development in a surface developer can be obtained by introducing the complexes in the emulsion in concentrations ranging from $10^{-9}$ to $10^{-6}$, preferably $10^{-8}$ to $5\times10^{-7}$, mole per silver mole. In these concentration ranges the transition metal complexes are useful in modifying the photographic properties of surface latent image forming negative working emulsions, which account for the majority of photographic emulsions. At concentrations ranging from $10^{-6}$ to $10^{-4}$, preferably $5\times10^{-6}$ to $5\times10^{-5}$, mole per silver mole significant trapping of photogenerated electrons within the interior of the grains is observed. At these concentrations the transition metal complexes are useful in reducing the surface sensitivity of negative working emulsions, as is sometimes desirable for specific applications, such as room light handling. Internal electron trapping is particularly useful in direct positive emulsions of the type which rely on photogenerated hole bleaching of surface fog (i.e., surface fogged direct positive emulsions) and internal latent image desensitization direct positive emulsions (e.g., direct positive core-shell emulsions of the type disclosed by Evans U.S. Pat. Nos. 3,761,276 and 3,923,513 and Evans et al U.S. Pat. No. 4,504,570). It is also possible to employ sufficient concentrations of the transition metal complex to shift latent image formation to the interior of the grains and still to use the emulsions as negative-working emulsions by employing an internal developer. Gilman et al U.S. Pat. No. 3,979,213 teaches the capability of obtaining superior spectral sensitivity employing such negative-working emulsions.

For the transition metal complexes containing iridium, somewhat lower concentrations in the emulsions can be employed to achieve similar photographic effects. Iridium carbonyl ligand complex concentrations in the range of from $1\times10^{-9}$ to $5\times10^{-7}$, preferably $10^{-8}$ to $10^{-7}$, mole per silver mole are contemplated to achieve significant performance advantages in emulsions which are imagewise exposed and developed in a surface developer—i.e., in surface latent image forming negative working emulsions. Significant levels of internal trapping of photogenerated electrons can be achieved at iridium complex concentrations as low as $1\times10^{-8}$ mole per silver mole, with useful complex concentrations ranging up $1\times10^{-4}$ mole per silver mole. Iridium carbonyl ligand complexes are preferably employed for internal electron trapping (e.g., in direct positive emulsions of the type described above) in concentrations ranging from $10^{-7}$ to $10^{-5}$ mole per silver mole.

The efficacy of transition metal carbonyl complex dopants in the concentration ranges set forth above are demonstrated in the Examples which follow.

Apart from the incorporated transition metal coordination complexes satisfying the requirements of the invention the silver halide grains, the emulsions of which they form a part, and the photographic elements in which they are incorporated can take any of a wide variety of conventional forms. A survey of these conventional features as well as a listing of the patents and publications particularly relevant to each teaching is provided by *Research Disclosure*, Item 17643, cited above, the disclosure of which is here incorporated by reference. It is specifically contemplated to incorporate transition metal coordination complexes satisfying the requirements of this invention in tabular grain emulsions, particularly thin (less than 0.2 μm) and/or high aspect ratio (>8:1) tabular grain emulsions, such as those disclosed in Wilgus et al U.S. Pat. No. 4,434,226; Kofron et al U.S. Pat. No. 4,439,520; Daubendiek et al U.S. Pat. Nos. 4,414,310, 4,693,964, and 4,672,027; Abbott et al U.S. Pat. Nos. 4,425,425 and 4,425,426; Wey U.S. Pat. No. 4,399,215; Solberg et al U.S. Pat. No. 4,433,048; Dickerson U.S. Pat. No. 4,414,304; Mignot U.S. Pat. No. 4,386,156; Jones et al U.S. Pat. No. 4,478,929; Evans et al U.S. Pat. No. 4,504,570; Maskasky U.S. Pat. Nos. 4,400,463, 4,435,501, 4,643,966, 4,684,607, 4,713,320, and 4,713,323; Wey et al U.S. Pat. No. 4,414,306; and Sowinski et al U.S. Pat. No. 4,656,122; the disclosures of which are here incorporated by reference.

EXAMPLES

The invention can be better appreciated by reference to the following specific examples:

EXAMPLE 1

AgCl powders were prepared in the absence of a peptizing agent with the variation being in the presence of $(NH_4)_2[Ru(CO)Cl_5]$ as a dopant. The $(NH_4)_2[Ru(CO)Cl_5]$ was prepared by a method similar to that of J. Halpern, B. R. James and A. L. W. Kemp, JACS 88(2), 5142 (1966).

The following solutions were prepared:

| | |
|---|---|
| Solution 1/1 | |
| Silver nitrate | 33.98 g |
| D.W.* to total volume | 100 mL |
| Solution 2/1 | |
| Potassium chloride | 15.66 g |
| D.W. to total volume | 100 mL |

*distilled water

An anionic transition metal complex $[Ru(CO)Cl_5]^{-2}$ was incorporated into the silver chloride grain crystal lattice by concurrently adding, in the dark, Solutions 1/1 and 2/1 through separate jets to a common reaction vessel. The $[Ru(CO)Cl_5]^{-2}$ complex was added as the ammonium salt in a concentration of 1 micromole per silver mole. The reaction vessel initially contained 100 mL of water. The contents of the reaction vessel were vigorously stirred during the concurrent introductions of the Solutions 1/1 and 2/1 over a period of 6 to 7 minutes. The addition rates were controlled manually with the only criteria being that addition of Solution 2/1 was equal to or up to 1 mL ahead of that of Solution 1/1.

The dopant was added either through a third jet or through the Solution 2/1 jet, with no noticeable differences being observed from this difference. The dopant was added in a number discrete steps during the additions of Solutions 1/1 and 2/1 when added through a third jet and continuously when added when incorporated in Solution 2/1.

The samples were thoroughly washed with approximately 500 mL of water for each 0.2 mole of silver precipitated. Thereafter, the samples were washed several times with approximately 50 mL of acetone per washing, the acetone being decanted after each washing, and filtered using a #2 qualitative paper filter. The washed samples were stored on open glass dishes in the dark until dry.

Ruthenium analysis using ion coupled plasma/atomic emission spectroscopy (hereinafter also referred to as ICP) showed that when the $[Ru(CO)Cl_5]^{-2}$ complex dopant was added during silver chloride precipitation, the ruthenium metal ion was incorporated into the silver chloride grain crystal structure with an efficiency of approximately 100 percent.

Electron paramagnetic resonance spectroscopic measurements were made on this powder at 20° K., using a standard X-band homodyne EPR spectrometer and standard cryogenic and auxilliary equipment, such as that described in Electron Spin Resonance, 2nd Ed., A Comprehensive Treatise on Experimental Techniques, C. P. Poole, Jr., John Wiley & Sons, New York, 1983. These measurements provided detailed structural information about the microscopic environment of the dopant ion, and, in this example, showed that either all or a major portion of the $[Ru(CO)Cl_5]^{-2}$ complex dopant ion was incorporated in the silver chloride grain crystal structure, with ligands intact in the Ru(II) valence state, replacing a $[AgCl_6]^{-5}$ moiety.

No EPR signals were observed in the unexposed doped samples that were not observed in the undoped control samples. After room temperature exposure to 365 nm light, strong EPR signals were observed at 20° K. These signals were not present in the control sample. Discernable in these signals was the powder pattern lineshape typically observed in a randomly oriented ensemble, such as a powder or frozen solution. The powder pattern had a perpendicular g feature at $g_{perp}=2.308\pm0.002$, and a linewidth of $65\pm5$ gauss, and a parallel g feature at $g_{par}=1.918\pm0.003$ and a linewidth of $50\pm10$ gauss. The isotropic g-value of this powder pattern (calculated as $[g_{par}+g_{perp}]/3$) was 2.18. This powder pattern was also observed when the doped unexposed silver chloride powder was placed in an oxidizing atmosphere of chlorine gas.

Based on the observations that this pattern was absent before exposure and was produced by the oxidizing atmosphere, it was concluded that the $[Ru(CO)Cl_5]^{-2}$ complex dopant was incorporated in the EPR invisible Ru(II) oxidation state and that some of the Ru(II) sites trapped holes (were oxidized) to produce the Ru(III) oxidation state during exposure or chlorination.

The measured g-values are completely consistent with the assignment of the state produced by room temperature exposure to Ru(III) ions. The g-values are very similar to those measured in frozen methanolic solution $10^{-4}$ molar in $(NH_4)_2[Ru(CO)Cl_5]$ ($g_{perp}$ of $2.325\pm0.002$ and a $g_{par}$ of $1.987\pm0.002$). The assignment of the silver chloride powder pattern to Ru(III) oxidation states is further supported by the similarity of the isotropic g-value ($g_{iso}$) of 2.18 measured in these investigations and the average $g_{iso}$ of 2.21 calculated from the g-values reported by A. Hudson and M. J. Kennedy, J. Chem. Soc. (A) 1116 (1969) for a wide range of ruthenium (III) salts in a range of frozen solvent solutions. Additionally, the g-values observed in this example from the Ru(III) photoproduct are very different from those observed previously for the Ru(I) photoproduct in $[Ru(II)(NO)Cl_5]^{-2}$ doped AgCl powder, described in McDugle et al U.S. Ser. No. 179,376, filed Apr. 8, 1988, commonly assigned.

It was established that the dopant was incorporated as $[Ru(CO)Cl_5]^{-3}$ with the ligands surrounding the ruthenium ion intact by comparing the measured g-values with those observed upon doping silver chloride powders with the chemically-feasible, ligand-exchanged contaminants of the dopant salt that might be produced during synthesis of the dopant or precipitation of the powder based on the series of $[Ru(CO)_xCl_yL_z]^{-n}$ compounds described by M. J. Cleare, Platinum Metal Reviews, 11(4) 148 (1967).

The g-values of the silver chloride grains produced by the doping procedure of this example were very different from the characteristic signals obtained by doping silver chloride with the anion $[RuCl_6]^{-3}$ or $[RuCl_{6-x}(H_2O)_x]^{x-3}$ (x=1 or 2).

From the foregoing it was concluded that the carbonyl ligand did not exchange with chloride or water during precipitation. Additionally, signals similar to those described in this example were not observed in $[Ru(CO)_2Cl_4]^{-2}$ doped silver chloride powders. Finally, the $[Ru(CO)Cl_5]^{-2}$ g-values were observed even in silver chloride powders prepared by adding the dopant from a 4M HCl solution. This method of addition prevented formation of a $[Ru(CO)Cl_4(H_2O)]^{-2}$ moiety, and thus it is concluded that the powder pattern described in this example did not arise from a $[Ru(CO)Cl_4(H_2O)]^{-2}$ complex.

Considering the high incorporation level of the dopant, as measured by ICP, the observation of a well-resolved EPR powder pattern from the doped powder, the high yield of the Ru(III) photoproduct, and the propensity of ruthenium complexes for six-fold coordination, it is clear that $[Ru(CO)Cl_5]^{-3}$ is incorporated substitutionally, replacing a $[AgCl_6]^{-5}$ moiety, rather than simply being occluded as a separate phase or present as a surface state.

Besides establishing that the $[Ru(CO)Cl_5]^{-2}$ complex dopant was incorporated substitutionally as $[Ru(CO)Cl_5]^{-3}$ with its ligands intact, the EPR measurements described above showed that the incorporated dopant could trap photogenerated holes. Thus, as a result of the presence of the novel ligand (CO), the trapping behavior was changed from that produced by incorporated $[RuCl_6]^{-3}$ and $[Ru(NO)Cl_5]^{-2}$ complex dopants, neither of which act as long-lived hole traps in silver chloride.

EXAMPLE 2

Investigations similar to those of Example 1 were undertaken, but with silver bromide being substituted for silver chloride.

Samples were prepared similarly as in Example 1, except that Solution 2/2 was substituted for Solution 2/1:

| Solution 2/2 | |
|---|---|
| Potassium bromide | 24.99 g |

-continued

| Solution 2/2 | |
|---|---|
| D.W. to total volume | 100 mL |

Ruthenium analysis by ICP showed that the $[Ru(CO)Cl_5]^{-2}$ dopant was incorporated in the silver bromide crystal structure with an efficiency of approximately 70 percent.

No EPR signals were observed in the unexposed doped sample which were attributable to the dopant and which were not observed in the undoped control sample. After room temperature exposue to 425 nm light, a strong EPR powder pattern was observed at 20° K., which was not present in the control sample. The powder pattern had a perpendicular g feature at $g_{perp}=2.363\pm0.002$, a parallel g feature at $g_{par}=1.994\pm0.003$, and an isotropic g feature, $g_{iso}$ of 2.24. This powder pattern was also observed when the unexposed silver bromide sample was placed in a bromide oxidizing atmosphere.

Based on the observations that this pattern was absent before exposure and produced by an oxidizing atmosphere, it was concluded that the dopant was incorporated in the EPR-invisible Ru(II) state and some of the Ru(II) sites trapped holes (were oxidized) to produce the Ru(III) state during light exposure or bromination. The measured g-values were completely consistent with the assignment of the long-lived state produced by room temperature exposure to Ru(III) ions. As in Example 1, the g-values were very similar to those measured in a frozen methanolic solution of the dopant salt. The assignment to Ru(III) is further supported by the similarity of the $g_{iso}$ of 2.24 measured in this example and the average $g_{iso}$ value of 2.21 calculated from the g-values reported by A. Hudson and M. J. Kennedy, J. Chem. Soc. (A), 1116 (1969).

It was established that the $[Ru(CO)Cl_5]^{-2}$ dopant was incorporated in the silver bromide sample with its carbonyl ligand intact by comparing the measured g-values with those observed upon doping silver chloride samples with all of the chemically feasible, ligand exchanged contaminants as described above in Example 1. From these comparisons it was concluded that the carbonyl ligand did not exchange with bromide or water during precipitation. The g-values observed were slightly, but consistently different from those observed in a silver bromide sample doped with $[Ru(CO)Br_5]^{-2}$, described below in Example 4. From this it was concluded that chloride ligands remained in the complex, unexchanged with bromide during precipitation.

For the reasons noted in Example 1, it was clear that the $[Ru(CO)Cl_5]^{-2}$ dopant was incorporated substitutionally as $[Ru(CO)Cl_5]^{-3}$, replacing a $[AgBr_6]^{-5}$ moiety, and was not simply occluded as a separate phase or present as a surface state.

Additionally, the EPR measurements described above showed that the incorporated ruthenium carbonyl ligand complex dopant trapped photoholes, a behavior not exhibited by either $[RuCl_6]^{-3}$ or $[Ru(NO)Cl_5]^{-2}$ dopants in silver bromide.

EXAMPLE 3

Investigations similar to those of Example 1 were undertaken, but with $(NH_4)_2[Ru(CO)Br_5]$ being employed to provide a ruthenium carbonyl complex dopant containing bromide rather than chloride ligands.

The $(NH_4)_2[Ru(CO)Br_5]$ complex salt was prepared by reacting $(NH_4)_2[Ru(CO)Cl_5]$ with HBr and evaporating the solution to dryness.

Ruthenium analysis by ICP showed that when the $[Ru(CO)Br_5]^{-2}$ dopant was added during the silver chloride precipitation, the ruthenium ion was incorporated into the silver chloride crystal structure with an efficiency of 87%±8%.

No EPR signals were observed in the unexposed doped sample which were attributable to the dopant and which were not observed in the undoped control sample. After room temperature exposure to 365 nm light, a strong EPR powder pattern was observed at 20° K., which was not present in the control sample. The powder pattern had a perpendicular g feature at $g_{perp}=2.301\pm0.002$, a parallel g feature at $g_{par}=1.929\pm0.003$, and an isotropic g feature, $g_{iso}$ of 2.18. This powder pattern was also observed when the unexposed silver bromide sample was placed in a chlorine oxidizing atmosphere.

Based on the observations that this pattern was absent before exposure and produced by an oxidizing atmosphere, it was concluded that the dopant was incorporated as the EPR-invisible Ru(II) state and some of the Ru(II) sites trapped holes (were oxidized) to produce the Ru(III) state during exposure or chlorination. The measured g-values were completely consistent with the assignment of the long-lived state produced by room temperature exposure to Ru(III) ions and were very close to those measured in Example 1.

It was established that the $[Ru(CO)Br_5]^{-2}$ dopant was substitutionally incorporated in the silver chloride sample as $[Ru(CO)Br_5]^{-3}$ with its carbonyl ligand intact by investigations and observations similar to those reported in Example 1.

EXAMPLE 4

Example 2 was repeated, except that the $(NH_4)_2[Ru(CO)Br_5]$ complex salt of Example 3 was substituted for $(NH_4)_2[Ru(CO)Cl_5]$.

Ruthenium analysis by ICP showed that when the $[Ru(CO)Br_5]^{-2}$ dopant was added during the silver bromide precipitation, the ruthenium ion was incorporated into the silver bromide crystal structure with an efficiency of 81%±9%.

No EPR signals were observed in the unexposed doped sample which were attributable to the dopant and which were not observed in the undoped control sample. After room temperature exposure to 425 nm light, a strong EPR powder pattern was observed at 20° K., which was not present in the control sample. The powder pattern had a perpendicular g feature at $g_{perp}=2.366\pm0.001$, a parallel g feature at $g_{par}=1.996\pm0.002$, and an isotropic g feature, $g_{iso}$ of 2.243. This powder pattern was also observed when the unexposed silver bromide sample was placed in a bromine oxidizing atmosphere.

Based on the observations that this pattern was absent before exposure and produced by an oxidizing atmosphere, it was concluded that the dopant was incorporated as the EPR-invisible Ru(II) state and some of the Ru(II) sites trapped holes (were oxidized) to produce the Ru(III) state during exposure or bromination.

It was established that the $[Ru(CO)Br_5]^{-2}$ dopant was substitutionally incorporated in the silver bromide sample as $[Ru(CO)Br_5]^{-3}$ with its carbonyl ligand intact by investigations and observations similar to those reported in Example 2.

EXAMPLE 5

This example describes the purification for use as a dopant of the complex salt $Cs_2[Os(CO)Cl_5]$ to remove $Cs_2[OsCl_6]$ impurities. The purpose in removing the $Cs_2[OsCl_6]$ impurities stems from prior knowledge that doping silver chloride grains with osmium hexachloride produces long-lived electron traps. Thus, the intent was to use purified $Cs_2[Os(CO)Cl_5]$ so that dopant observations could be definitely attributed to the osmium carbonyl complex as opposed to the osmium hexachloride complex. More specifically, purification was desired to permit EPR examination of silver halides doped with the osmium carbonyl complex. The complex $[OsCl_6]^{-2}$ is incorporated in silver chloride as EPR-active $[OsCl_6]^{-3}$ and as such shows strong characteristic signals detectable in parts per million.

The complex salt $Cs_2[Os(CO)Cl_5]$ contains $Cs_2[OsCl_6]$ as an impurity, whether prepared by the method described by M. J. Cleare and W. C. Griffith, J. Chem. Soc. (A), 372 (1969) and J. Chem. Soc. (A), 2788 (1970) or purchased commercially (Johnson Matthey & Co., Ltd.). The complex salt prepared by the procedure of Cleare et al was purified as follows: An aqueous solution of the $Cs_2[Os(CO)Cl_5]$ containing $Cs_2[OsCl_6]$ as an impurity was titrated to slight excess with $AgNO_3$ and then regenerated with 1N HCl. This procedure precipitated all of the $[OsCl_6]^{-2}$ as the insoluble silver salt and removed any excess of silver ion as silver chloride, both of which were removed as precipitates by centrifugation.

The mother liquor was decanted. This was then treated with 4M HCl to convert any aquated osmium carbonyl complexes back to $[Os(CO)Cl_5]^{-2}$. This solution was evaporated to dryness to yield a purified $Cs_2[Os(CO)Cl_5]$ complex salt free of $Cs_2[OsCl_6]$ contamination.

Unless otherwise indicated, in all subsequent references the $[Os(CO)Cl_5]^{-2}$ complex is to be understood as having been purified by the procedure described in this example.

EXAMPLE 6

Silver chloride and silver bromide samples were prepared similarly as in Examples 1 and 2, respectively, except that the variation made was in the presence of $Cs_2[Os(CO)Br_5]$ as a complex salt. This complex salt was prepared by reacting $Cs_2[Os(CO)Cl_5]$, purified as described in Example 5, with HBr and evaporating the solution to dryness.

Osmium analysis by ICP showed that when the osmium carbonyl bromide complex salt was added during precipitation, the metal ion osmium was incorporated with an efficiency of 44%±4% in AgCl and 52%±4% in AgBr.

No EPR signals attributable to the dopant and not observed in the undoped control were observed in the unexposed powders. After room temperature exposure to 365 nm light for AgCl and 425 nm light for AgBr, EPR signals were observed at 20° K., which were not present in the undoped control samples. The EPR signals occurred at $g_{perp}=2.511\pm0.002$ for AgCl and $g_{perp}=2.503\pm0.002$ for AgBr. This powder pattern was also observed when the unexposed AgCl and AgBr samples were placed in chlorine and bromine oxidizing atmospheres, respectively.

Based on these observations it was concluded that osmium carbonyl complex was incorporated in its EPR-invisible Os(II) oxidation state and that some of the incorporated complexes trapped holes (i.e., were oxidized) to produce the corresponding Os(III) oxidation state during exposure or halogenation.

The measured g-values were completely consistent with the assignment of the states produced by room temperature exposure to Os(III) oxidation state ions, based on the similarity of the signals obtained from $[Os(CO)Cl_5]^{-2}$ in the depeptized AgCl emulsion reported below in Example 21.

The g-values produced by this example were very different from the characteristic signals obtained by doping AgCl or AgBr with the osmium hexahalide anion, $[OsCl_6]^{-2}$ as reported by R. S. Eachus and M. T. Olm, Radiat. Eff. (GB) 73(1-4) 69, 1983. From this it was concluded that the carbonyl ligand did not exchange with halide during precipitation. It is also certain that the carbonyl ligand was not replaced by water during the precipitation, since no signals which could be attributed to EPR-active $[OsBr_5(H_2O)]^{-2}$ were observed, either before or after exposure. In this example the osmium carbonyl ligand complex salt was added to a 4M salt solution, which prevented the formation of an $[Os(CO)Br_4(H_2O)]^{-2}$ complex.

Based on the observation of a well resolved EPR powder pattern from the doped emulsion sample noted above, the high yield of the Os(III) photoproduct, and the propensity of Os(III) complexes for six-fold coordination, it is clear that the osmium carbonyl ligand complex was incorporated substitutionally, replacing a $[AgX_6]^{-5}$ moiety, where X is $Cl^-$ or $Br^-$, rather than simply being occluded as a separate phase or present as a surface state.

EPR studies also revealed that other defects introduced by the $[Os(CO)Br_5]^{-2}$ dopant acted as shallow electron trapping centers. The presence of these centers was indicated by the detection of a single symmetric line at $g=1.88\pm0.001$ in AgCl and $g=1.49\pm0.001$ in AgBr during exposure of the powders at temperatures lower than 50° K. This agrees with a g-value of 1.49 reported previously for shallow trapped electrons in AgBr, J. Z. Brescia, R. S. Eachus, R. James and M. T. Olm Cryst. Latt. Def. and Amorph. Mat. 17, 165 (1987). Shallow electron traps differ from deep electron traps in that for the former the electron is not strongly bound to the trapping center, and the EPR signal detected principally reflects the characteristics of the host material and not the dopant.

Besides establishing that the $[Os(CO)Br_5]^{-2}$ dopant was incorporated substitutionally as $[Os(CO)Br_5]^{-3}$ with its ligands intact, the EPR measurements described above show that the incorporated dopant can trap photoholes and shallowly trap photoelectrons. Thus, as a result of the presence of the novel carbonyl ligand, the trapping behavior was changed from that of $[OsBr_6]^{-3}$.

EXAMPLE 7

Investigations similar to those of Example 1 were undertaken, but with $Na_3[Fe(CO)(CN)_5]$ being employed to provide an iron carbonyl complex dopant.

The iron carbonyl complex salt was prepared from purified $Na_3[Fe(CN)_5(NH_3)]$ which was synthesized by recrystallization of $Na_3[Fe(CN)_5(NO)]$ (Alfa Chemicals) from an ammonium hydroxide solution. Carbon monoxide was then bubbled through an aqueous, degassed soluton of $Na_3[Fe(CN)_5(NH_3]$ at ambient temperature in the dark. The resulting solution was evaporated to dryness, with the product $Na_3[Fe(CO)(CN)_5]$ being dried in the dark.

Iron analysis by ICP showed that when the dopant was added during the AgCl precipitation, the iron ion was incorporated into the powders with an efficiency of 69 percent.

No EPR signals not observed in the control powder and attributable to the dopant were observed in this example before exposure. After room temperature exposure to 365 nm light, strong EPR powder pattern signals were observed at 20° K., which were not present in the dopant free control sample. These signals and g-values of $g_{perp}=2.277\pm0.001$, $g_{par}=1.934\pm0.002$ and $g_{iso}=2.163$. This powder pattern was also observed when the unexposed doped AgCl sample was placed in a chlorine gas oxidizing atmosphere.

Based on the observation that the EPR pattern was absent before exposure and was produced either by exposure or the oxidizing atmosphere, it was concluded that the dopant was incorporated in the EPR invisible Fe(II) oxidation state and that some of the Fe(II) oxidation states trapped holes (i.e., were oxidized) to produce the Fe(III) oxidation state during exposure or chlorination.

The incorporation of iron in its Fe(II) oxidation state was not achieved when the dopant complex contained only halide ligands. The incorporation incorporation of the dopant complex in the Fe(II) oxidation state was made possible by the presence of the carbonyl and cyano ligands, which stabilized the divalent oxidation state of the iron ion.

The measured g-values were completely consistent with the assignment of the state produced by room temperature exposure the Fe(III) ions in a low spin (electron spin-paired) ground state. The presence of a low spin, rather than a high spin Fe(III) ground state was a result of the presence of carbonyl and cyano ligands coordinated with the iron ion—i.e., forming a first ligand shell surrounding the iron ion. When halide ions make up the first ligand shell surrounding Fe(II) or Fe(III) in AgCl, iron has been observed to have a high spin ground state.

The assignment of the observed powder pattern to Fe(II) is further supported by the similarly of the observed g-values with those collated by R. E. DeSimone, JACS 95(19), 6238 (1973) for low spin Fe(II) complexes, and the dissimilarity from EPR spectra observed for Fe(I) hexacyano complexes doped into alkali halides. Additionally, loss of the carbonyl ligand did not occur during precipitation, since the observed signals differed from those observed from AgCl powders doped with $[Fe(CN_6)]^{-3}$ or $[Fe(CN)_5(H_2O)]^{-2}$.

Given the high dopant incorporation level of the dopant as measured by ICP, the observation of a well-resolved EPR powder pattern, the high yield of the Fe(III) photoproduct, and the propensity of low spin iron complexes for six fold coordination, it is clear that $[Fe(CO)(CN)_5]^{-3}$ was incorporated substitutionally, replacing a $[AgCl_6]^{-5}$ moiety, and is not simply occluded as a separate phase or present as a surface state.

EPR studies also revealed that the defects introduced by the $[Fe(CO)(CN)_5]^{-3}$ complex dopant acted as shallow electron trapping centers. The presence of these centers was indicated by the detection of a single symmetric line at $g=1.88\pm0.001$ during exposure of the sample at temperatures lower than 50° K.

Besides establishing that the $[Fe(CO)(CN)_5]^{-3}$ complex dopant was incorporated substitutionally with its ligands intact, the EPR measurements described above showed that the incorporated dopant could trap photogenerated holes and shallowly trap photogenerated electrons.

EXAMPLE 8

Investigations similar to those of Example 1 were undertaken, but with $K_2[Ir(CO)Br_5]$ employed for sample doping. The iridium complex salt was prepared according to the method of M. J. Cleare and W. P. Griffith, J. Chem. Soc. (A), 373 (1969). Iridium analysis by ICP showed that when the dopant was added during the AgCl precipitation, the iridium ion was incorporated into the powders with an efficiency of 73 percent. Given the high incorporation level of the dopant as measured by ICP, and the propensity of iridium complexes for six fold coordination, it is believed that the dopant was incorporated substitutionally, replacing a $[AgCl_6]^{-5}$ moiety, and was not simply occluded as a separate phase or present as a surface state.

EXAMPLE 9

Investigations similar to those of Example 1 were undertaken, but with $Cs_2[Ru(CO)_2Br_4]$ employed for sample doping. The $Cs_2[Ru(CO)_2Br_4]$ complex salt was prepared from $Cs_2[Ru(CO)_2Cl_4]$, which was in turn formed by reacting in concentrated HCl CsCl and $Ru(CO)_2Cl_2$, the latter being prepared as taught by R. Colton and R. H. Farthing, Aust. J. Chem., 20, 1283 (1967). The chloride ligand complex salt was converted to the bromide ligand complex salt by dissolving the former in concentrated HBr and evaporating to dryness. Ruthenium analysis by ICP showed that when the dopant was added during the AgCl precipitation, the ruthenium ion was incorporated into the powders with an efficiency of 13 percent.

EXAMPLES 10–19

Emulsion 1U (A Control Emulsion)

Six solutions were prepared as follows:

| | |
|---|---|
| Solution 1(10) | |
| Gelatin (bone) | 50 g |
| D.W. | 2000 mL |
| Solution 2(10) | |
| Sodium bromide | 10 g |
| D.W. | 100 mL |
| Solution 3(10) | |
| Sodium bromide | 412 g |
| D.W. to total volume | 1600 mL |
| Solution 4(10) | |
| Silver nitrate (5 Molar) | 800 mL |
| D.W. to total volume | 1600 mL |
| Solution 5(10) | |
| Gelatin (phthalated) | 50 g |
| D.W. | 300 mL |
| Solution 6(10) | |
| Gelatin (bone) | 130 g |
| D.W. | 400 mL |

Solution 1(10) was adjusted to a pH of 3.0 at 40° C. with nitric acid. The temperature of Solution 1(10) was adjusted to 70° C. Solution 1(10) was the adjusted to a pAg of 8.2 with Solution 2(10). Solutions 3(10) and 4(10) were simultaneously run into the adjusted Solution 1(10) at a constant rate for the first 4 minutes with introduction being accelerated for the next 40 minutes. The addition rate was held constant over a final 2 minute period for a total addition time of 46 minutes. The pAg was maintained at 8.2 over the entire run. After the concurrent addition of Solutions 3(10) and 4(10), the temperature was adjusted to 40° C., the pH was adjusted to 4.5, and Solution 5(10) was added. The mixture was then held for 5 minutes, after which the pH was adjusted to 3.0 and the gel was allowed to settle. At the same time the temperature was dropped to 15° C. before decanting the liquid layer. The depleted volume was restored with distilled water. The pH was readjusted to 4.5, and the mixture was held at 40° C. for ½ hour before the pH was adjusted to 3.0 and the settling and decanting steps were repeated. Solution 6(10) was added, and the pH and pAg were adjust to 5.6 and 8.2, respectively.

Emulsion 1U was divided. One portion was digested for 30 minutes at 70° C. with 2 mg per Ag mole of $Na_2S_2O_3(5H_2O)$ while another portion was similarly digested, but with 3 mg per Ag mole of $KAuCl_4$ additionally being present.

Emulsion 1D (An Example Emulsion)

Example Emulsion 1D was prepared similarly as Control Emulsion 1U, except that $Cs_2[Ir(CO)Cl_5]$ was added in the amount of 25 micromoles per silver mole (final silver content) in the time period extending from the first 5 minutes of silver salt addition until 75% of the silver had been introduced into the reaction vessel.

Emulsion 2D (An Example Emulsion)

Example Emulsion 2D was prepared similarly as Example Emulsion 1D, except that $Cs_2[Ir(CO)Cl_5]$ was added in the amount of 0.1 micromole per silver mole (final silver content).

Emulsion 3D (An Example Emulsion)

Example Emulsion 3D was prepared similarly as Example Emulsion 1D, except that $K_2[Ir(CO)Cl_5]$ was added in the amount of 25 micromoles per silver mole (final silver content). Analysis indicated that less than 7.6 percent of iridium was incorporated within the grain structure.

Emulsion 4D (An Example Emulsion)

Example Emulsion 3D was prepared similarly as Example Emulsion 1D, except that $K_2[Ir(CO)Cl_5]$ was added in the amount of 0.1 micromole per silver mole (final silver content).

Emulsion 5D (An Example Emulsion)

Example Emulsion 5D was prepared similarly as Example Emulsion 1D, except that $Cs_2[Os(CO)Cl_5]$ was added in the amount of 25 micromoles per silver mole (final silver content). Analysis indicated that less than 12 percent of osmium was incorporated within the grain structure.

Emulsion 6D (An Example Emulsion)

Example Emulsion 6D was prepared similarly as Example Emulsion 1D, except that $Cs_2[Os(CO)Cl_5]$ was added in the amount of 0.1 micromole per silver mole (final silver content).

Emulsion 7D (An Example Emulsion)

Example Emulsion 7D was prepared similarly as Example Emulsion 1D, except that $Cs_2[Ru(CO)_2Cl_4]$ was added in the amount of 25 micromoles per silver mole (final silver content).

Emulsion 8D (An Example Emulsion)

Example Emulsion 8D was prepared similarly as Example Emulsion 1D, except that $K_2[Ru(CO)_2Cl_4]$ was added in the amount of 25 micromoles per silver mole (final silver content). Analysis indicated that less than 26 percent of the ruthenium was incorporated within the grain structure.

Emulsion 9D (An Example Emulsion)

Example Emulsion 9D was prepared similarly as Example Emulsion 1D, except that $Cs[Ru(CO)_3Cl_3]$ was added in the amount of 25 micromoles per silver mole (final silver content). Analysis indicated that less than 13 percent of the ruthenium was incorporated within the grain structure.

Photographic Comparison

Coatings of each of the above emulsions were made at 27 mg Ag/dm$^2$ and 86 mg gelatin/dm$^2$. To investigate the ability of the dopants to modify the photographic response of surface latent image forming negative working emulsion, each coating exposed for 0.1 second to 365 nm radiation on a standard sensitometer and then developed for 6 minutes in a hydroquinone-Elon TM (N-methyl-p-aminophenol hemisulfate) surface developer SD-1.

The results are summarized in Table II below.

TABLE II

| Emul. | Dopant | Conc.* | Photog. Speed S | Photog. Speed S + Au |
|---|---|---|---|---|
| 1U | None | — | 100 | 100 |
| 1D | $Cs_2[Ir(CO)Cl_5]$ | 25 | <1 | <1 |
| 2D | $Cs_2[Ir(CO)Cl_5]$ | 0.1 | 11 | 6 |
| 3D | $K_2[Ir(CO)Cl_5]$ | 25 | <1 | <1 |
| 4D | $K_2[Ir(CO)Cl_5]$ | 0.1 | 65 | 71 |
| 5D | $Cs_2[Os(CO)Cl_5]$ | 25 | <1 | <1 |
| 6D | $Cs_2[Os(CO)Cl_5]$ | 0.1 | 89 | 85 |
| 7D | $Cs_2[Ru(CO)_2Cl_4]$ | 25 | 63 | 71 |

*Micromoles dopant added per silver mole

Emulsions 8D and 9D showed no measureable photographic speed when developed in the surface developer SD-1, but when 0.5 g potassium iodide per liter was added to the developer to convert it to an internal developer, both Emulsion 8D and 9D produced a photographic image, indicating the formation of an internal latent image and internal trapping of photogenerated electrons.

EXAMPLE 20

Emulsion 20A (A Control Emulsion)

Five solutions were prepared as follows:

| | |
|---|---|
| Solution 1(20) | |
| Gelatin (bone) | 60 g |
| D.W. | 2000 mL |
| Solution 2(20) | |
| Sodium chloride | 876 g |
| D.W. | 2678 mL |
| Solution 3(20) | |
| Silver nitrate | 2123 g |
| D.W. to total volume | 2073 mL |
| Solution 4(20) | |
| Gelatin (phthalated) | 60 g |
| D.W. | 1140 mL |
| Solution 5(20) | |
| Gelatin (bone) | 146 g |
| D.W. | 1316 mL |

Solution 1(20) was adjusted to a pH of 3.0 at 40° C. with nitric acid. The temperature of Solution 1(20) was adjusted to 55° C. Solution 1(20) was the adjusted to a pAg of 7.3 with Solution 2(20). Solutions 2(20) and 3(20) were simultaneously run into the adjusted Solution 1(20) at a constant rate for the first 3 minutes with introduction being accelerated for the next 31 minutes. The pAg was maintained at 7.3 over the entire run. After the concurrent addition of Solutions 2(20) and 3(20), the temperature was adjusted to 40° C., the pH was adjusted to 3.5. The gel was allowed to settle and the liquid layer was decanted. The depleted volume was restored with distilled water. The temperature was adjusted to 40° C. The pH was adjusted to 6.0 and then readjusted to 3.5. The settling and decanting steps were repeated. Solution 5(20) was added, distilled water was added to give a final weight of 3000 g, and the pH was adjusted to 5.6.

Emulsions 20B, 20C, and 20D (Example Emulsions)

Example Emulsion 20B was prepared similarly as Control Emulsion 20A, except that Solution 2(20)B was substituted for Solution 2(20) after the first 3 minutes of precipitation, with the original Solution 2(20) being substituted for the last 8 minutes of precipitation. Example Emulsion 20C was prepared similarly as Example Emulsion 20B, except that Solution 2(20)B was replaced with Solution 2(20)C. Example Emulsion 20D was prepared similarly as Example Emulsion 20B, except that Solution 2(20)B was replaced with Solution 2(20)D. Analysis for osmium indicated that 42 percent of the osmium added was incorporated in the grain crystal structure.

| | |
|---|---|
| Solution 2(20)B | |
| $Cs_2[Os(CO)Cl_5]$ | 0.050 g |
| Solution 2(20) | 711 g |
| Solution 2(20)C | |
| Solution 2(20)B | 28 g |
| Solution 2(20) | 711 g |
| Solution 2(20)D | |
| Solution 2(20)C | 71 g |
| Solution 2(20) | 711 g |

Sensitizations and Photographic Comparison

A portion of each of the emulsions was given a conventional sulfur plus gold surface chemical sensitization and prepared for coating by the addition of more gelatin and a spreading agent. Another portion of each emulsion was given a gold only surface chemical sensitization and similarly prepared for coating. A third portion of each emulsion was similarly coated, but without adding either sulfur or gold sensitizers.

Coatings of each emulsion portion were identically made on cellulose acetate film support and exposed through a step tablet to 365 nm radiation. To assess performance of the coatings as surface latent image negative working emulsions each exposed coating with processed for 10 minutes in an ascorbic acid-Elon TM (N-methyl-p-aminophenol hemisulfate) surface developer, SD-2, which was formulated to contain no bromide salts. To assess internal latent image forming properties, coatings of each of the emulsion portions were also processed after exposure in a hydroquinone-Elon TM (N-methyl-p-aminophenol hemisulfate) surface developer converted to an internal developer, ID-1, by the addition of 0.5 g of iodide per liter. To insure the absence of surface latent image sites the coatings were treated for 5 minutes in a ferricyanide bleach before processing for 6 minutes in ID-1.

Analysis of the results demonstrated that all of the Emulsion 20 samples formed a surface latent image. At the lowest internal dopant concentrations (Emulsion 20D), the surface speeds and corresponding minimum densities of the emulsions increased somewhat. With progressively higher dopant concentrations (Emulsions 20C and 20B), the surface speed and corresponding minimum densities of the emulsions were reduced, caused by the progressive shift of latent image sites from the surface of the grains to their interior. Surface development contrast declined as a function of dopant concentration.

Results are illustrated below in Table III for the gold only surface chemically sensitized emulsion portions developed in SD-2:

TABLE III

| Emul. | Conc.* | Speed | Contrast | Dmin |
|---|---|---|---|---|
| 20A | None | 100 | 3.20 | 0.37 |
| 20D | 0.1 | 149 | 3.25 | 0.91 |
| 20C | 1.0 | 87 | 2.87 | 0.23 |
| 20B | 25 | 5 | 1.69 | 0.08 |

*Micromoles dopant added per silver mole

From Table III it is apparent that a molar concentration of dopant of $10^{-7}$ mole per silver mole produces a speed increase in a surface latent image forming a negative working emulsion, thereby corroborating a useful doping range for such emulsions of from $10^{-9}$ to less than $10^{-6}$ mole per silver mole, preferably $10^{-8}$ to $5\times10^{-7}$ mole per silver mole.

On the other hand, surface desensitization at dopant concentrations of $10^{-6}$ mole per silver mole provide corroboration for a useful range for internal electron trapping (direct positive imaging) of $10^{-6}$ to $10^{-4}$, preferably $5\times10^{-6}$ to $5\times10^{-5}$, mole per silver mole.

EXAMPLE 21

The purpose of this example is to confirm incorporation of the $[Os(CO)Cl_5]^{-2}$ ligands in the AgCl grain structure, starting with emulsion samples, thereby demonstrating that dopant incorporation in a AgCl grain structure was achieved when incorporation was undertaken in the presence of peptizer as well as in the absence of a peptizer, as demonstrated in Examples 1 to 9 inclusive.

The AgCl emulsions 20(A) (undoped) and 20(C) (doped) were examined by EPR. Prior to examination by EPR, peptizer was removed by three consecutive aqueous washes, and the remaining AgCl powder was freeze dried. No EPR signals attributable to the dopant and not observed in the undoped control 20(A) were observed in the unexposed, depeptized emulsion 20(C). After room temperature exposure to 365 nm light, an EPR powder pattern was observed at 20° K., which was not present in the control emulsion. The powder pattern was from a center with a nonaxial symmetry and thus had three g-values. These occurred at $g_1=2.500\pm0.002$, $g_2=2.461\pm0.002$, and $g_3=1.326\pm0.003$. The isotropic g-value of this powder pattern (calculated as the average the three g-values) was 2.10. This powder pattern was also observed when the unexposed, depeptized AgCl emulsion was placed in an oxidizing chlorine gas atmosphere.

Based on the observation that this pattern was absent before exposure and was produced by exposure or an oxidizing atmosphere, it was concluded that the dopant of Emulsion 20(C) was incorporated in the EPR invisible Os(II) oxidation state and that some of the Os(II) sites trapped holes (i.e., were oxidized) during exposure or chlorination to produce Os(III) oxidation states.

The measured g-values were similar to those observed for a frozen methanolic solution containing a $10^{-4}$ molar concentration of the $Cs_2[Os(CO)Cl_5]$ complex salt ($g_{perp}=2.459\pm0.002$, $g_{par}=1.583\pm0.002$, and $g_{iso}=2.17$).

It was deduced that the dopant was incorporated as $[Os(CO)Cl_5]^{-3}$ with its ligand shell intact by comparing the observed g-values with those observed upon doping AgCl powders with chemically reasonable modifications of the dopant salt, such as those described by M. J. Cleare, Platinum Metal Reviews, 11(4) 148 (1967). The g-values of this example were very different from the characteristic signals obtained by doping AgCl with the osmium hexachloride anion (R. S. Eachus and M. T. Olm, Radiat. Eff. (GB) 73(1-4) 69, (1983). From this it was concluded that the carbonyl ligand did not exchange with chloride during precipitation. It is also certain that the carbonyl ligand was not replaced by water during the precipitation, since no signals attributable to the EPR active $[OsCl_5(H_2O)]^{-2}$ species were observed, either before or after exposure. Additionally, in AgCl samples precipitated in the absence of peptizer and doped with the anion $[OsCl_4(CO)(H_2O)]^{-2}$, the signals detected were different from those described for this example. In this example, the dopant was added to a 4M salt solution, thereby preventing formation of the $[OsCl_4(CO)(H_2O)]^{-2}$ complex. The EPR signal reported for this example also could not arise from $[OsCl_4(CO)_2]^{-2}$ or $[OsCl_3(CO)_3]^{-1}$, since these salts were not present in the dopant salt, as confirmed by infra-red spectroscopy. Additionally, in AgCl powders and emulsions intentionally doped with $[OsCl_3(CO)_3]^{-1}$ the signals reported in this example were not observed.

Considering the high dopant incorporation level, as measured by ICP, the observation of a well resolved EPR powder pattern from the doped emulsion, the high yield of the Os(III) photoproduct and the propensity of the Os(III) complexes for six fold coordination, it is clear that the $[Os(CO)Cl_5]^{-2}$ dopant incorporated substitutionally as $[Os(CO)Cl_5]^{-3}$, replacing a $[AgCl_6]^{-5}$ moiety and was not simply occluded as a separate phase or present as a surface state.

In addition, the EPR measurements described above showed that the incorporated dopant could trap photoholes. Thus, as a result of the presence of the carbonyl ligand, the trapping behavior was changed from that of $[OsCl_6]^{-3}$ and $[Os(NO)Cl_5]^{-2}$, neither of which act as long lived hole traps in AgCl.

EPR studies also revealed that the defects introduced by the $[Os(CO)Cl_5]^{-2}$ dopant act as shallow electron trapping centers. The presence of these centers was indicated by the detection of a single symmetric line at $g=1.88\pm0.001$ during exposure of the emulsion at temperatures lower than 50° K. Thus, well known shallow electron traps in AgCl, such as $Pb^{+2}$ and $Cd^{+2}$, give a low temperature EPR signal at $g=1.88$, R. S. Eachus, R. E. Graves, and M. T. Olm, Phys. Stat. Sol. (B) 88, 705 (1978).

EXAMPLE 22

Emulsion 22(A) (A Control Emulsion)

This emulsion was identical to control Emulsion 20(A) in its precipitation, sulfur and gold sensitization, coating, exposure, and processing in surface and internal developers.

Emulsions 22(B), 22(C), and 22(D) (Example Emulsions)

Emulsions 22(B), 22(C), and 22(D) were prepared similarly as Emulsions 20(B), 20(C), and 20(D), respectively, except that Solutions 2(20)B, 2(20)C, and 2(20)D were replaced with Solutions 2(22)B, 2(22)C, and 2(22)D, respectively.

| | |
|---|---|
| Solution 2(22)B | |
| $(NH_4)_2[Ru(CO)Cl_5]$ | 0.026 g |
| Solution 2(20) | 711 g |
| Solution 2(22)C | |
| Solution 2(22)B | 28 g |
| Solution 2(20) | 711 g |
| Solution 2(22)D | |
| Solution 2(22)C | 71 g |
| Solution 2(20) | 711 g |

Sensitization, coating, exposure, and processing were identical to that for Emulsion 20(A).

Photographic Properties

Results for sulfur and gold sensitized emulsion coatings processed in surface developer SD-2 are provided below in Table IV to illustrate typical results:

TABLE IV

| Emul. | Conc.* | Speed | Contrast | Dmin |
|---|---|---|---|---|
| 22A | None | 100 | 3.78 | 0.515 |
| 22D | 0.1 | 85 | 4.16 | 0.676 |
| 22C | 1.0 | 93 | 3.45 | 0.587 |
| 22B | 25 | 5 | 5.37 | 0.484 |

By comparing Tables III and IV it is apparent that the substitution of ruthenium for osmium in the carbonyl ligand complex dopants produced the similar result of surface desensitization at increasing incorporation levels. However, at the same time, results were obtained using the ruthenium carbonyl ligand complex dopant that were not predictable from use of the corresponding osmium dopant. For example, using ruthenium carbonyl ligand dopants no increase in surface speed was observed at even the lowest attempted doping level, a distinct departure from the results observed in Example 20. Another departure was the increased surface development contrast observed in the ruthenium carbonyl ligand complex doped emulsions, whereas surface development contrast obtained using the corresponding osmium dopant in all instances was less than that of the undoped control.

EXAMPLE 23

Example 22 was repeated, except that $(NH_4)_2[Ru(CO)Br_5]$ was substituted for $(NH_4)_2[Ru(CO)Cl_5]$. Results comparable to those reported in Table IV are summarized below in Table V.

TABLE V

| Emul. | Conc.* | Speed | Contrast | Dmin |
|---|---|---|---|---|
| 23A | None | 100 | 3.28 | 0.750 |
| 23D | 0.1 | 95 | 3.34 | 0.810 |
| 23C | 1.0 | 74 | 4.90 | 0.362 |
| 23B | 25 | 6 | 5.61 | 0.272 |

*Micromoles dopant added per silver mole

The results show that the substitution of bromide for chloride ligands does not qualitatively alter performance.

EXAMPLE 24

Example 22 was repeated, except that $Cs[Ru(CO)_3Cl_3]$ was substituted for $(NH_4)_2[Ru(CO)Cl_5]$. Results comparable to those reported in Tables IV and V are summarized below in Table VI.

TABLE VI

| Emul. | Conc.* | Speed | Contrast | Dmin |
|---|---|---|---|---|
| 24A | None | 100 | 4.38 | 0.193 |
| 24D | 0.1 | 105 | 4.72 | 0.195 |
| 24C | 1.0 | 89 | 4.15 | 0.343 |
| 24B | 25 | No Surface Response | | |

*Micromoles dopant per silver mole

Surface speed and contrast increased at the lowest doping level without any significant increase in minimum density. This demonstrates the advantages available for doping levels in the concentration ranges of less than $10^{-6}$ mole per silver mole. At doping levels of $10^{-6}$ mole per silver mole and above there is a progressive shift toward internal latent image formation, as reflected by the lower surface speed and contrast.

EXAMPLE 25

Emulsion 25A (A Control Emulsion)

At 46° C., 240 g of gelatin were added to a reaction vessel containing 6 liters of water along with 1.2 grams of a thioether silver halide ripening agent of the type disclosed in McBride U.S. Pat. No. 3,271,157. The chloride concentration was adjusted to 0.041 molar. Concentrated aqueous silver nitrate was introduced into the vigorously stirred reaction vessel contents along with sufficient aqueous sodium chloride to maintain the stated concentration of halide ion. Sufficient material was added to make 3 moles of approximately 0.5 μm mean edge length silver chloride cubic grains.

Emulsion 25B (An Example Emulsion)

The procedure employed to prepare Emulsion 25A was repeated, except that an aqueous solution containing $K_2[Ir(CO)Cl_5]$ to give a reaction vessel concentration of 0.0133 mg of the complex salt per silver mole, based on the final silver content, was added concurrently with the silver and halide salt solutions, starting after 9 percent of the silver nitrate had been introduced and continuing until 69 percent of the silver nitrate had been introduced.

Emulsion 25C (An Example Emulsion)

This emulsion was prepared identically to Emulsion 25B, except that $K_2[Ir(CO)Cl_5]$ was added to give a reaction vessel concentration of 0.2855 mg of the complex salt per silver mole, based on final silver.

Coating, Exposure, and Processing

After washing, the emulsions were identically gold sensitized and prepared for coating by introducing additional gelatin and a spreading agent. Portions of each emulsion were identically coated on a cellulose acetate film support and exposed through a step tablet to 365 nm radiation.

Coated samples of each of the emulsions were first investigated by processing in a hydroquinone-Elon TM (N-methyl-p-aminophenol hemisulfate) surface developer SD-1. Modifications of emulsion performance demonstrated in the surface developer are reported in Table VII, below:

TABLE VII

| Emul. | Conc.* | Speed | Contrast | Dmax |
|---|---|---|---|---|
| 25A | None | 100 | 2.22 | 2.51 |
| 25B | 0.03 | 132 | 1.94 | 2.16 |
| 25C | 0.6 | 8 | 2.71 | 2.13 |

*Micromoles dopant added per Ag mole

From Table VII it is apparent that at a low concentration ($3\times10^{-8}$ mole per silver mole) of the iridium carbonyl ligand complex dopant the surface speed of the emulsion was significantly increased. On the other hand, when the concentration of the iridium dopant was increased above $5\times10^{-7}$ mole per silver mole, the surface speed of the emulsion was severely reduced. These results corroborate the concentration range of from $1\times10^{-9}$ to $5\times10^{-7}$, preferably $1\times10^{-8}$ to $1\times10^{-7}$, of iridium carbonyl ligand complex dopant per silver mole for usefully modifying the surface image forming properties of silver halide emulsions.

To investigate the internal latent image forming properties of the emulsions, separate coatings of each emulsion were alternatively bleached for 5 minutes in ferricyanide to remove developable surface silver from the grains and then processed in a hydroquinone-Elon TM (N-methyl-p-aminophenol hemisulfate) developer to which 0.5 g of iodide per liter was added, ID-1. The results are summarized in Table VIII.

TABLE VIII

| Emul. | Conc.* | Contrast | Dmax |
|---|---|---|---|
| 25A | None | 0.09 | 0.24 |
| 25B | 0.03 | 1.26 | 1.48 |
| 25C | 0.6 | 2.49 | 1.60 |

*Micromoles dopant added per Ag mole

From Table VIII it is apparent that even at the $3\times10^{-8}$ mole per silver mole dopant level, which is responsible for increasing surface speed, as shown in Table VII, the iridium cabonyl ligand complex dopant is already improving internal contrast and maximum density, indicating the presence of internal latent image forming sites within the grains. This example then corroborates the utility of a $1\times10^{-8}$ to $1\times10^{-4}$, preferably $1\times10^{-7}$ to $1\times10^{-5}$, mole of iridium carbonyl ligand complex dopant to enhance performance of internal latent image (e.g., direct positive) emulsions.

EXAMPLE 26

Emulsion 26A (A Control Emulsion)

At 55° C., 90 g of gelatin were added to a reaction vessel containing 4 liters of water. The chloride concentration was adjusted to 0.041 molar by introducing sodium chloride. Concentrated aqueous silver nitrate was introduced in the vigorously stirred contents of the reaction vessel along with sufficient aqueous sodium chloride to maintain the stated molar concentration of chloride ion. Sufficient salts were added to make 3 moles of approximately 0.3 μm mean edge length silver chloride cubic grains.

Emulsion 26B (An Example Emulsion)

The procedure employed to prepare Emulsion 26A was repeated, except that an aqueous solution containing $Cs_2[Ru(CO)_2Cl_4]$ to give a reaction vessel concentration of 14.1 mg of the complex salt per silver mole, based on the final silver content, was added concurrently with the silver and halide salt solutions, starting after 1 percent of the silver nitrate had been introduced and continuing until 76 percent of the silver nitrate had been introduced.

Coating, Exposure, and Processing

After washing, the emulsions were identically prepared for coating by introducing additional gelatin and a spreading agent. Portions of each emulsion were identically coated on a cellulose acetate film support and exposed through a step tablet to 365 nm radiation.

Coated samples of each of the emulsions were first investigated by processing in a hydroquinone-Elon TM (N-methyl-p-aminophenol hemisulfate) surface developer SD-1. Modifications of emulsion performance demonstrated in the surface developer are reported in Table IX, below:

TABLE IX

| Emul. | Conc.* | Speed | Contrast | Dmin |
|---|---|---|---|---|
| 26A | None | 100 | 4.48 | 0.03 |
| 26B | 25 | 3 | 4.50 | 0.03 |

*Micromoles dopant added per Ag mole

From Table IX it can be seen that the dopant did not significantly alter either surface contrast or minimum density (fog). On the other hand, speed was significantly reduced, indicating that latent image sites had shifted to the interior of the grains as a result of dopant incorporation.

The invention has been described in detail with particular reference to preferred embodiments thereof, but it will be understood that variations and modifications can be effected within the spirit and scope of the invention.

What is claimed is:

1. A photographic emulsion comprised of radiation sensitive silver halide grains exhibiting a face centered cubic crystal lattice structure internally containing a carbonyl coordination ligand and a transition metal selected from groups 8 and 9 of the periodic table of elements.

2. A photographic emulsion according to claim 1 further characterized in that said emulsion contains a hexacoordination complex that satisfies the formula:

$$[M(CO)_mL_{6-m}]^n$$

where

M is a transition metal selected from groups 8 and 9 of the periodic table of elements;

L is a bridging ligand;

m is 1, 2, or 3; and n is −1, −2, or −3.

3. A photographic emulsion according to claim 1 further characterized in that the halide forming the grains is comprised of at least one of chloride and bromide optionally in combination with iodide.

4. A photographic emulsion according to claim 2 further characterized in that the hexacoordination complex is present in a concentration ranging form $10^{-9}$ to $10^{-4}$ mole per silver mole.

5. A photographic emulsion according to claim 2 further characterized in that M is a group 8 transition metal.

6. A photographic emulsion according to claim 2 further characterized in that M is a fifth period transition metal.

7. A photographic emulsion according to claim 5 further characterized in that the hexacoordination complex is incorporated in the grains in a concentration sufficient to enhance the photographic imaging response of the emulsion to a surface developer following imagewise exposure.

8. A photographic emulsion according to claim 7 further characterized in that the bridging ligands are halide ligands and the hexacoordination complex is incorporated in the grains in a concentration ranging from $10^{-9}$ to $10^{-6}$ mole per silver mole.

9. A photographic emulsion according to claim 8 further characterized in that the hexacoordination complex is incorporated in the grains in a concentration ranging from $10^{-8}$ to $5\times10^{-7}$ mole per silver mole.

10. A photographic emulsion according to claim 6 further characterized in that the hexacoordination complex is incorporated in the grains in an amount sufficient to trap photogenerated electrons internally.

11. A photographic emulsion according to claim 10 further characterized in that the bridging ligands are halide ligands and the hexacoordination complex is incorporated in the grains in a concentration ranging from $10^{-6}$ to $10^{-4}$ mole per silver mole.

12. A photographic emulsion according to claim 11 further characterized in that the hexacoordination complex is incorporated in the grains in a concentration ranging from $5\times10^{-6}$ to $5\times10^{-5}$ mole per silver mole.

13. A photographic emulsion according to claim 2 further characterized in that M is a sixth period transition metal.

14. A photographic emulsion according to claim 13 further characterized in that M is iridium.

15. A photographic emulsion according to claim 14 further characterized in that the hexacoordination complex is incorporated in the grains in a concentration sufficient to enhance the photographic imaging response of the emulsion to a surface developer following imagewise exposure.

16. A photographic emulsion according to claim 15 further characterized in that the bridging ligands are halide ligands and the hexacoordination complex is incorporated in the grains in a concentration ranging from $10^{-9}$ to $5\times10^{-7}$ mole per silver mole.

17. A photographic emulsion according to claim 16 further characterized in that the hexacoordination complex is incorporated in the grains in a concentration ranging from $10^{-8}$ to $10^{-7}$ mole per silver mole.

18. A photographic emulsion according to claim 13 further characterized in that the hexacoordination complex is incorporated in the grains in an amount sufficient to trap photogenerated electrons internally.

19. A photographic emulsion according to claim 18 further characterized in that the hexacoordination complex is incorporated in the grains in a concentration ranging from $10^{-8}$ to $10^{-4}$.

20. A photographic emulsion according to claim 19 further characterized in that the hexacoordination complex is incorporated in the grains in a concentration ranging from $10^{-7}$ to $10^{-5}$ mole per silver mole.

21. A photographic silver halide emulsion comprised of radiation sensitive silver halide grains exhibiting a face centered cubic crystal lattice structure interally containing from $10^{-8}$ to $10^{-4}$ mole per silver mole of a complex satisfying the formula:

$$[M(CO)_mL_{6-m}]^n$$

where

M is ruthenium or osmium;

L is a halide ligand;

m is 1, 2, or 3; and n is −1, −2, or −3.

22. A photographic silver halide emulsion comprised of radiation sensitive silver halide grains exhibiting a face centered cubic crystal lattice structure internally containing from $10^{-9}$ to $5\times10^{-5}$ mole per silver mole of a complex satisfying the formula:

$$[Ir(CO)L_5]^{-2}$$

where L is a halide ligand.

23. A photographic emulsion according to any one of claims 1 to 12 inclusive further characterized in that the transition metal is ruthenium.

24. A photographic emulsion according to any one of claims 1 to 20 or 22 inclusive further characterized in that the silver halide grains are comprised of silver chloride.

25. A photographic emulsion according to any one of claims 1 to 20 or 22 inclusive further characterized in that the silver halide grains are comprised of silver bromide optionally in combination with iodide.

* * * * *